US006991492B2

(12) United States Patent
Ho et al.

(10) Patent No.: US 6,991,492 B2
(45) Date of Patent: Jan. 31, 2006

(54) MEMORY CARD CONNECTOR

(75) Inventors: Yi-Tse Ho, Gian (TW); Katsutoshi Tojo, Yamato (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/953,221

(22) Filed: Sep. 29, 2004

(65) Prior Publication Data

US 2005/0079765 A1 Apr. 14, 2005

(30) Foreign Application Priority Data

Oct. 14, 2003 (TW) ..... 92218263 U

(51) Int. Cl.
*H01R 13/66* (2006.01)

(52) U.S. Cl. ..... 439/541.5; 439/64

(58) Field of Classification Search ..... 439/64, 439/79, 541.5, 630

See application file for complete search history.

(56) References Cited

U.S. PATENT DOCUMENTS 5,601,438 A * 2/1997 Ho et al. ..... 439/64
6,027,365 A * 2/2000 Kaufman ..... 439/489
6,736,671 B2 * 5/2004 Lee ..... 439/541.5

* cited by examiner

*Primary Examiner*—Gary Paumen
*Assistant Examiner*—James R. Harvey
(74) *Attorney, Agent, or Firm*—Charles S. Cohen

(57) ABSTRACT

A memory card connector is provided for mounting on a printed circuit board. The connector includes an insulating housing having a rear terminal-mounting section and at least one longitudinal side wall section extending forwardly from one end of the rear section and combining therewith to define a card-receiving space for receiving a memory card. An array of terminals are mounted on the rear section and have contact portions projecting into the space for engaging appropriate contacts on the memory card. The terminals have tail portions projecting downwardly for engaging appropriate circuit traces on the printed circuit board. A tail guiding plate is mounted to the bottom of the rear section and has channels for receiving the tails portions of the terminals and aligning the tail portions with the circuit traces on the printed circuit board.

7 Claims, 2 Drawing Sheets

MEMORY CARD CONNECTOR

FIELD OF THE INVENTION

This invention generally relates to the art of electrical connectors and, particularly, to a memory card connector for mounting on a printed circuit board and including an improved tail guiding means.

BACKGROUND OF THE INVENTION

Memory cards are known in the art and contain intelligence in the form of a memory circuit or other electronic program. Some form of card reader reads the information or memory stored on the card. Such cards are used in many applications in today's electronic society, including video cameras, digital still cameras, smartphones, PDA's, music players, ATMs, cable television decoders, toys, games, PC adapters, multi-media cards and other electronic applications. Typically, a memory card includes a contact or terminal array for connection through a card connector to a card reader system and then to external equipment. The connector readily accommodates insertion and removal of the card to provide quick access to the information and program on the card. The card connector includes terminals for yieldingly engaging the contact array of the memory card.

The memory card connector often is mounted on a printed circuit board. The memory card, itself, writes or reads via the connector and can transmit between electrical appliances, such as a word processor, personal computer, personal data assistant or the like. With circuit board mounted connectors, the terminals of a connector include tail portions which are connected to appropriate circuit traces on the printed circuit board by various systems, such as surface mount technology where the tail portions are reflow soldered to the circuit traces. Through hole technology involves inserting the tail portions of the terminals into holes in the printed circuit board for connection, as by soldering, to circuit traces on the board and/or in the holes. Both surface mount technology and through hole technology involve relatively high temperatures and are permanent connections. If it is desired to be able to easily remove and maintain or replace a memory card connector from the printed circuit board, the tail portions of the terminals are simply maintained under pressure against the circuit traces on the board.

All of these systems of electrically coupling the terminals of the memory card connector to the circuit traces on the printed circuit board create problems of aligning the terminal tail portions with the circuit traces. The tail portions can be misaligned or even deformed during shipping, assembly or other handling of the memory card connector. The tail portions can even deform due to the high temperatures of a reflow soldering process which is necessary for the surface mount technology as well as the through hole technology. These problems are multiplied when a connector is designed for receiving more than one memory card, such as two different types of memory cards requiring two different arrays of terminals with two sets of tail portions. The present invention is directed to solving these problems.

SUMMARY OF THE INVENTION

An object, therefore, of the invention is to provide a new and improved memory card connector for mounting on a printed circuit board.

In the exemplary embodiment of the invention, the connector includes an insulating housing having a rear terminal-mounting section and at least one longitudinal side wall section extending forwardly from one end of the rear section and combining therewith to define a card-receiving space for receiving one or more memory cards. The side wall section has first and second inside longitudinal grooves for receiving first and second memory cards. An array of first terminals are mounted on the rear terminal-mounting section of the housing and have contact portions projecting into the space for engaging appropriate contacts on the first memory card and tail portions projecting downwardly for engaging appropriate circuit traces on the printed circuit board. An array of second terminals are mounted on the rear section with similar contact portions arid tail portions. A tail guiding plate is mounted to the bottom of the rear section and has first and second channels for receiving the tails portions of the first and second terminals, respectively, and aligning the tail portions with the respective circuit traces on the printed circuit board.

According to one aspect of the invention, the rear terminal-mounting section of the housing has a receptacle at the bottom thereof within which the tail guiding plate is mounted. Generally, interengaging orienting means are provided between the tail guiding plate and the housing to properly orient the plate with respect to the tail portions of the terminals. Specifically, the orienting means herein are provided by interengaging tongue-and-groove means between the tail guiding plate and the rear section of the housing to properly orient the plate within the receptacle.

According to another aspect of the invention, the arrays of first and second terminals comprise generally parallel first and second rows thereof. The channels in the tail guiding plate are arranged in a corresponding pair of rows. The channels comprise through passages through which the tail portions of the terminals project out of the bottom of the tail aligning plate for engaging the circuit traces on the printed circuit board.

Other features of the invention include an ejection mechanism having first and second ejecting arms for the first and second memory cards, respectively. The insulating housing includes a baffle groove between the first and second card-receiving grooves. A metallic baffle plate is positionable in the baffle groove to provide electromagnetic interference protection between the memory cards. It should be understood that the invention and advantages provided by the tail guiding plate are equally applicable for a memory card connector which receives a single memory card.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
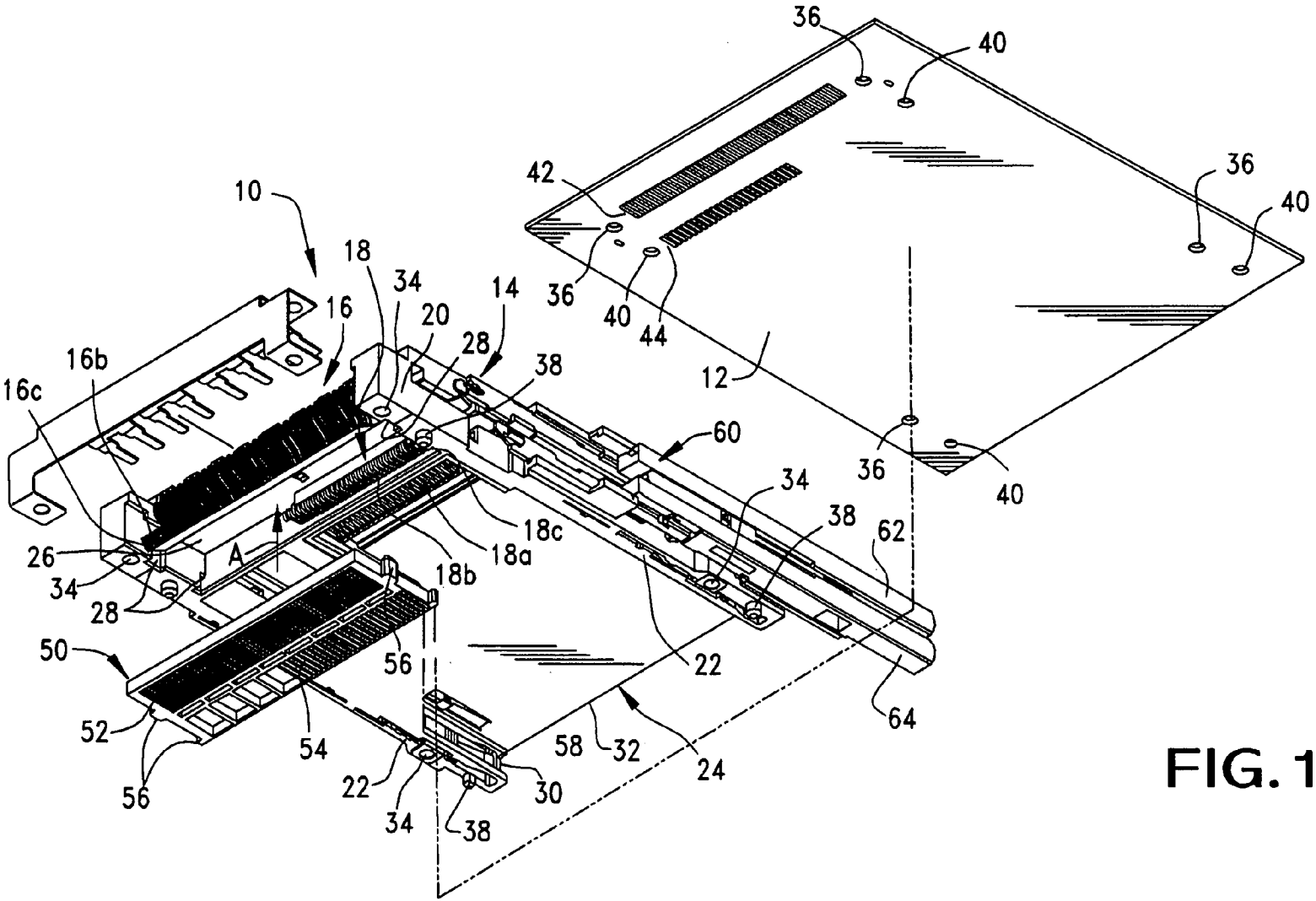
FIG. 1 is an exploded, bottom perspective view of a memory card connector embodying the concepts of the invention, in conjunction with a printed circuit board on which the connector is mounted.
Figure 2:
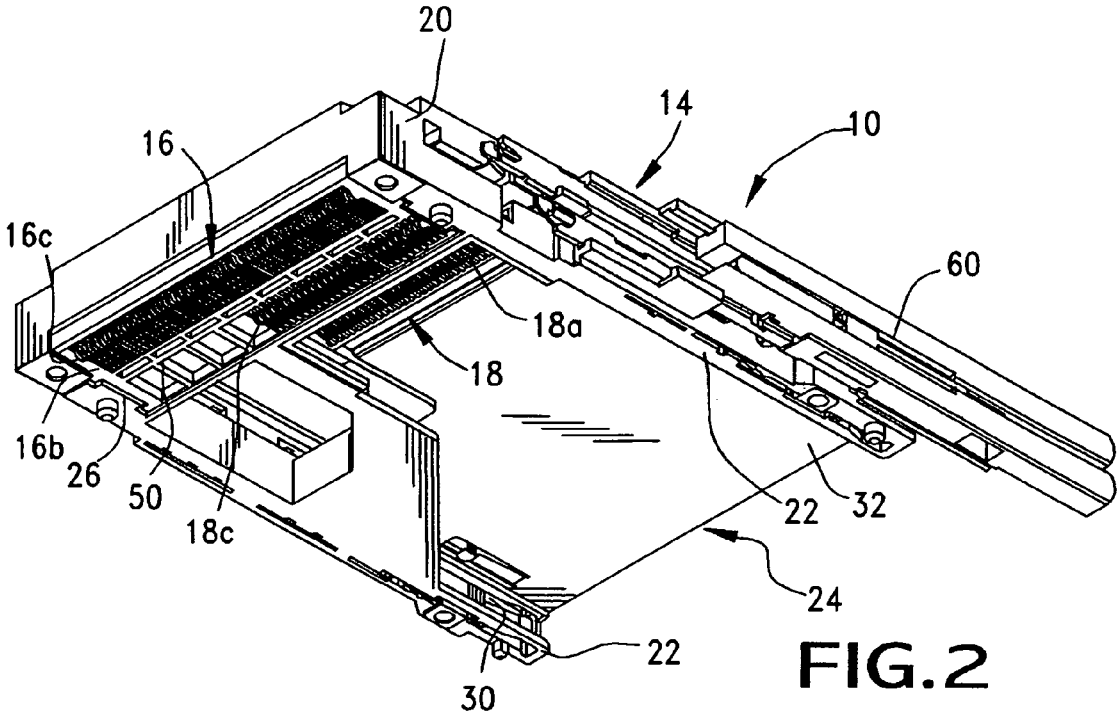
FIG. 2 is a bottom perspective view of the connector in assembled condition.

Referring to the drawings in greater detail, and first to FIGS. 1 and 2, the invention is embodied in a memory card connector, generally designated 10, for mounting on a printed circuit board 12. The connector includes an insulating or dielectric housing, generally designated 14, which mounts a first array of terminals, generally designated 16, and a second array of terminals, generally designated 18.

More particularly, housing 14 of memory card connector 10 includes a rear terminal-mounting section 20 and a pair of side wall sections 22 which extend forwardly from opposite ends of the rear section to form a generally U-shaped configuration which defines a card-receiving space, generally designated 24, for receiving one or more memory cards. Rear section 20 of the housing has a rectangular receptacle 26 which is provided with vertical grooves 28 in the opposite end faces of the receptacle. Each side wall section 22 includes a pair of upper and lower longitudinal grooves 30 for receiving two memory cards. The lower groove 30 is quite visible in FIGS. 1 and 2, but the upper groove is not visible because of the presence of a metal baffle plate 32 which will be described hereinafter. A pair of through holes 34 are formed through the housing at opposite ends of rear section 20 and near the front of side wall sections 22 for securing the connector to circuit board 12 through holes 36 in the board. Finally, a plurality of positioning or mounting posts 38 project downwardly from the housing for insertion into a plurality of mounting holes 40 in the printed circuit board.

All of the terminals 16 and 18 in the first and second arrays thereof include contact portions which project into space 24 for engaging appropriate contacts on the first and second memory cards inserted into longitudinal grooves 30. Contact portions 18*a* of terminals 18 are visible in FIGS. 1 and 2. Again, the contact portions of terminals 16 are not visible because of the presence of baffle plate 32. Terminals 16 and 18 also include bent portions 16*b* and 18*b*, respectively, which lead to tail portions 16*c* and 18*c*, respectively, as is seen clearly in the drawings. Tails portions 16*c* of terminals 16 are engageable with circuit traces 42 (FIG. 1) on circuit board 12, and tail portions 18*c* of terminals 18 are engageable with circuit traces 44 on the circuit board. It can be seen that terminals 16 and 18 are arranged in two generally parallel rows across rear section 20 of the housing which results in tail portions 16*c* and 18*c* being in two generally parallel linear arrays corresponding to the two generally parallel or linear arrays of circuit traces 42 and 44 on the circuit board.

In order to guide tail portions 16*c* and 18*c* of terminals 16 and 18, respectively, into alignment with circuit traces 42 and 44, respectively, on circuit board 12, the invention contemplates the provision of a tail guiding plate, generally designated 50. The guiding plate is rectangular and sized to fit into rectangular receptacle 26 in the bottom of housing 14 along the rear terminal-mounting section 20 of the housing. The plate has a linear array of channels in the form of through passages 52 for receiving tail portions 16*c* of terminals 16 therethrough. The plate also has a linear array of channels in the form of through passages 54 for receiving tail portions 18*c* of terminals 18 therethrough. The plate has a plurality of ribs or tongues 56 for positioning in grooves 28 of receptacle 26. The tongues and grooves are asymmetrical to ensure proper orientation of the plate.

Guiding plate 50 is positioned into receptacle 26 in the direction of arrow □A□(FIG. 1). Tail portions 16*c* and 18*c* of terminals 16 and 18, respectively, will pass through the channels or passages 52 and 54, respectively, of the guiding plate so that the tail portions are exposed at the bottom of the plate for engaging circuit traces 42 and 44, respectively, on printed circuit board 12. The plate prevents the tail portions from moving and precisely aligns the tail portions with the circuit traces regardless of the process used to connect the tail portions to the circuit traces, whether the process is a surface soldering process or a surface pressure process. In addition, it should be understood that the guiding plate would be equally applicable for use with tail portions which are inserted into holes in the printed circuit board.

Connector 10 includes a baffle groove 58 in the inside surface of each side wall section 22 of the housing between the upper and lower longitudinal grooves 30 which receive the two memory cards. Baffle plate 32 is inserted into baffle grooves 58. The baffle plate is fabricated of metal material and provides electromagnetic interference (EMI) protection between the memory cards by providing a metal barrier therebetween.

Connector 10 also includes an ejection mechanism, generally designated 60, mounted on one of the side walls sections 22 of the housing. The ejection mechanism includes a pair of independently operable ejecting arms 62 and 64 for ejecting one or both of the two memory cards which are insertable into the connector.

It can be seen in FIGS. 1 and 2 that the first array of terminals 16 extends completely across the rear of the card-receiving space 24, with the tail portions 16*c* of the terminals also in a long row. Printed circuit board 12 also has a corresponding long row of circuit traces 42 for engaging tail portions 16*c*. However, terminals 18 are in a shorter row thereof with a shorter row of tail portions 18*c* for engaging the shorter row of circuit traces 44 on the printed circuit board. Terminals 16 may be applicable for engaging the contacts on a "card bus" type memory card, while the shorter array of terminals 18 might be applicable for engaging the contacts of a "newcard" type memory card inserted into the connector.

Figure 3:
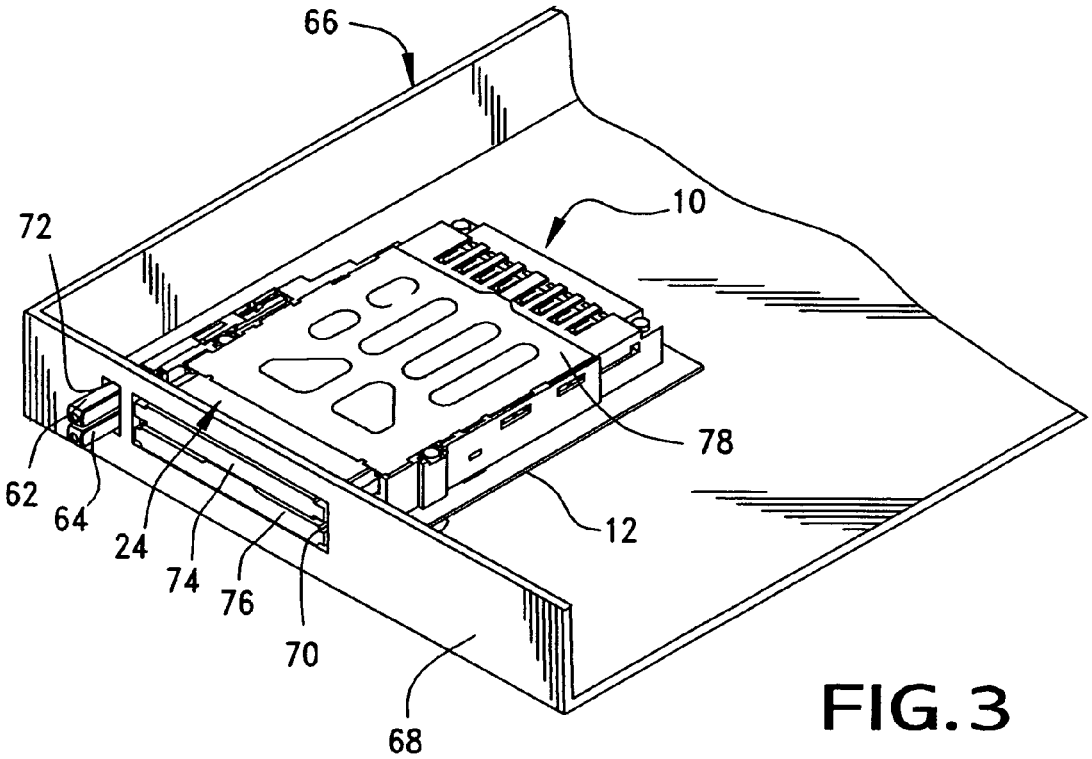
FIG. 3 is a perspective view of the assembled connector mounted on a chassis.

FIG. 3 shows memory card connector 10 mounted in a chassis, generally designated 66, of an electrical appliance. The chassis has an outer wall 68 with an elongated opening 70 and a smaller opening 72. First and second memory cards 74 and 76 are shown as having been inserted through opening 70 and into the card-receiving space 24 of memory card connector 10. Ejecting arms 62 and 64 of the ejection mechanism are shown projecting through opening 72 and exposed for manual manipulation by an operator. Finally, FIG. 3 shows that the memory card connector includes a metal top plate 78 which is not visible in the previously described depictions in FIGS. 1 and 2.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A memory card connector for mounting on a printed circuit board, comprising:

an insulating housing having a rear terminal-mounting section and at least one longitudinal side wall section extending forwardly from one end of the rear section and combining therewith to define a card-receiving space, the side wall section having first and second inside longitudinal grooves for receiving first and second memory cards, respectively;

an array of first terminals mounted on the rear terminal-mounting section of the housing and having contact portions projecting into said space for engaging appropriate contacts on the first memory card and tail portions projecting downwardly with a contact surface parallel to the printed circuit board extending from bent portions of the first terminals for engaging appropriate circuit traces on the printed circuit board;

an array of second terminals mounted on the rear terminal-mounting section of the housing and having contact portions projecting into said space for engaging appropriate contacts on the second memory card and tail portions projecting downwardly with a contact surface parallel to the printed circuit board extending from bent portions of the second terminals for engaging appropriate circuit traces on the printed circuit board; and a tail guiding plate mounted to the bottom of the rear terminal-mounting section of the housing and having first and second channels for receiving the tails portions of the first and second terminals, respectively, and aligning the contact surfaces of the tail portions with the respective circuit traces on the printed circuit board, said channels comprising through passages defined by two side walls, perpendicular to the printed circuit board, through which the contact surfaces of the tail portions of the terminals project where side edges of the contact surfaces are adjacent to respective side walls in a respective through passage in the plate.

2. The memory card connector of claim 1 wherein said rear terminal-mounting section of the housing has a receptacle at the bottom thereof within which the tail guiding plate is mounted.

3. The memory card connector of claim 2, including interengaging tongue-and-groove means between the tail guiding plate and the rear section of the housing to properly orient the plate within said receptacle.

4. The memory card connector of claim 1 wherein said arrays of first and second terminals comprise generally parallel first and second rows of terminals, and the channels in the tail guiding plate are arranged in a corresponding pair of rows.

5. The memory card connector of claim 1, including an ejection mechanism including first and second ejecting arms for the first and second memory cards, respectively.

6. The memory card connector of claim 1 wherein said insulating housing includes a baffle groove between said first and second grooves, and including a metallic baffle plate positionable in the baffle groove to provide electromagnetic interference protection between the memory cards.

7. The memory card connector of claim 1, including interengaging orienting means between the tail guiding plate and the housing to properly orient the plate with respect to the tail portions of the terminals.

* * * * *